US008544955B2

(12) United States Patent
Kim

(10) Patent No.: US 8,544,955 B2
(45) Date of Patent: Oct. 1, 2013

(54) TILTABLE CHAIR

(75) Inventor: Joonyeob Kim, Seoul (KR)

(73) Assignee: Sidiz, Inc., Gyeonggi-do (KR)

( * ) Notice: Subject to any disclaimer, the term of this patent is extended or adjusted under 35 U.S.C. 154(b) by 117 days.

(21) Appl. No.: 13/123,102

(22) PCT Filed: Oct. 9, 2009

(86) PCT No.: PCT/KR2009/005783

§ 371 (c)(1),
(2), (4) Date: Apr. 7, 2011

(87) PCT Pub. No.: WO2010/041895

PCT Pub. Date: Apr. 15, 2010

(65) Prior Publication Data

US 2011/0193387 A1 Aug. 11, 2011

(30) Foreign Application Priority Data

Oct. 10, 2008 (KR) ..... 10-2008-0099693

(51) Int. Cl.
*A47C 1/00* (2006.01)

(52) U.S. Cl.
USPC ..... 297/316; 297/285; 297/322; 297/341

(58) Field of Classification Search
USPC ..... 297/300.5, 285, 292, 293, 317, 322, 297/343, 342, 341
See application file for complete search history.

(56) References Cited

U.S. PATENT DOCUMENTS 4,854,641 A * 8/1989 Reineman et al. ..... 297/344.15
5,397,165 A 3/1995 Grin et al.
5,660,439 A * 8/1997 Unwalla ..... 297/316
6,086,153 A * 7/2000 Heidmann et al. ..... 297/300.1
6,431,649 B1 * 8/2002 Hensel ..... 297/300.2

(Continued)

FOREIGN PATENT DOCUMENTS

JP 2000-287782 10/2000
KR 1998-073534 11/1998

(Continued)

OTHER PUBLICATIONS

International Search Report for international application No. PCT/KR2009/005783, dated Jun. 1, 2010 (4 pages).

*Primary Examiner* — David Dunn
*Assistant Examiner* — Alexander Harrison
(74) *Attorney, Agent, or Firm* — Hamre, Schumann, Mueller & Larson, P.C.

(57) ABSTRACT

The present invention relates to a tillable chair. Specifically, the present invention relates to a tilting chair that enables tilting by combining the left plate body (110) and back plate body (120) with a tilt (130), wherein said back plate body (120) comprises a back plate backbone (122) and a back plate (124) that is combined with a moving means (150) to allow movement in up and down directions with respect to said back plate backbone (122), the front part of said left plate body (110) is combined with one side of said tilt (130), said back plate backbone (122) is combined with another side of said tilt (130), and the rear part of said left plate body (110) is combined with said back plate body (120). According to such configuration, slippage between the human body and back plate does not take place upon tilting so that the comfort level of a user may be enhanced, and a spinal cord may be effectively protected by maintaining a state of lordosis.

5 Claims, 5 Drawing Sheets

(56) References Cited

U.S. PATENT DOCUMENTS

| | | | | |
|---|---|---|---|---|
| 6,439,661 | B1 | 8/2002 | Bräuning | |
| 6,609,775 | B1 * | 8/2003 | Moro et al. | 347/14 |
| 6,817,667 | B2 * | 11/2004 | Pennington et al. | 297/284.4 |
| 7,458,637 | B2 | 12/2008 | Norman et al. | |
| 7,490,902 | B2 * | 2/2009 | Aubert | 297/300.5 |
| 7,625,045 | B2 * | 12/2009 | Hatcher et al. | 297/300.2 |
| 2005/0275263 | A1 * | 12/2005 | Norman et al. | 297/284.4 |
| 2012/0062006 | A1 * | 3/2012 | Hall et al. | 297/300.5 |

FOREIGN PATENT DOCUMENTS

| | | |
|---|---|---|
| KR | 1020030059582 | 7/2003 |
| KR | 20-0336009 | 12/2003 |
| KR | 1020040090670 | 10/2004 |
| KR | 1020080037029 | 4/2008 |

* cited by examiner

TILTABLE CHAIR

TECHNICAL FIELD

The present invention relates, in general, to a tiltable chair and, more particularly, to a tiltable chair which prevents slippage between a human body and a back plate upon tilting.

BACKGROUND ART

Generally, if a person works while seated on his or her chair in a fixed posture for long periods, the supply of blood and nutrients to the intervertebral disk is blocked. Thus, as time passes, the intervertebral disk becomes stiffened. Particularly, a bad posture leads to an abnormal spinal line, and causes the kyphosis that is a rearward curved line. If the kyphosis continues, the intervertebral disk of the spine compresses spinal nerves, thus causing back pain.

Therefore, a user sitting in a chair needs to frequently bend his or her back backwards and provide proper movement to the spine in order to ease the strain of the intervertebral disk and surrounding muscles and to supply blood and nutrients. Thereby, a chair having a tilting function has been disclosed, which is constructed so that the chair is tilted according to the user's movement.

As shown in FIG. 1, a conventional chair having a tilting device is provided with a mounting member 4 on which a seat plate 2 is mounted. The mounting member 4 is connected to a tilt 8 via a hinge shaft 6. The tilt 8 is connected to a leg 10. A back plate connector 14 and a lever 16 are coupled to the tilt 8. Here, the back plate connector is connected to a back plate 12, and the lever adjusts the tilting angle of the back plate. Further, an armrest 18 is coupled to a central part of each side edge of the seat plate 2 so as to support a user's arm.

DISCLOSURE

Technical Problem

However, when the conventional tiltable chair is tilted from a position of FIG. 2*a* to a position of FIG. 2*b*, the rotational center (the pelvic region) R1 of the human body and the rotational center R2 of the chair are different from each other, so that there is a difference between the movement of the chair and the movement of the human body. That is, after tilting, there occurs a difference by a distance L between a point M marked on the human body and a point C marked on the chair. This results in slippage between the human body and the back plate of the chair upon tilting, thus causing inconvenience.

Accordingly, the present invention has been made keeping in mind the above problems occurring in the prior art, and an object of the present invention is to provide a tiltable chair, which is capable of preventing slippage between a human body and a back plate upon tilting.

Technical Solution

In order to accomplish the above object, the present invention provides a tiltable chair constructed so that a seat plate body and a back plate body are coupled to a tilt to allow the chair to be tilted, wherein the back plate body includes a back plate frame and a back plate which is coupled to the back plate frame in such a way as to move up and down with respect to the back plate frame by moving means, a front part of the seat plate body is coupled to one side of the tilt, the back plate frame is coupled to another side of the tilt, and a rear part of the seat plate body is coupled to the back plate body.

The moving means may include a lower connecting part arranged with a lower part of the back plate connected to the back plate frame, and an upper connecting part arranged with an upper part of the back plate connected to the back plate frame. The lower connecting part may have a hinge connecting structure or a link connecting structure using a plurality of links.

The upper connecting part may have a sliding connecting structure or a link connecting structure using one link.

The lower connecting part having the link connecting structure using the plurality of links comprising first, second, third, and fourth links, wherein one end of the first link is hinged to the seat plate body, the other end of the first link is hinged to one end of the second link, a central part of the second link is hinged to the back plate frame, the other end of the second link is hinged to one end of the third link, the other end of the third link is hinged to one end of the fourth link and the back plate, the other end of the fourth link is hinged to the back plate frame.

Advantageous Effects

According to the present invention, a tiltable chair is advantageous in that slippage does not occur between a human body and a back plate upon tilting, thus enhancing a user's comfort, and protecting the spine by maintaining a state of lordosis.

BEST MODE

Hereinafter, a tiltable chair according to an embodiment of the present invention will be described in detail with reference to the accompanying drawings.

Figure 1:
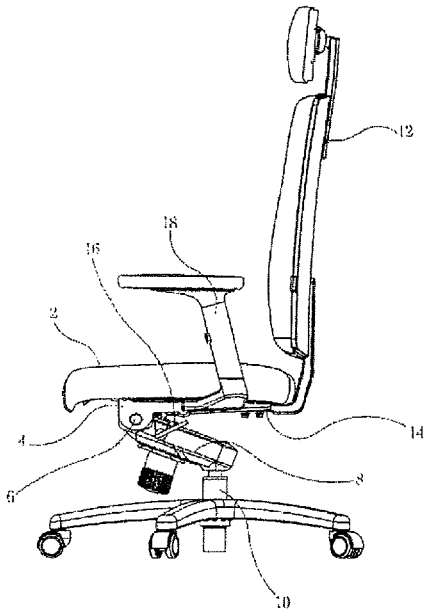
FIG. 1 is a view showing the construction of a conventional tiltable chair.
Figure 2:
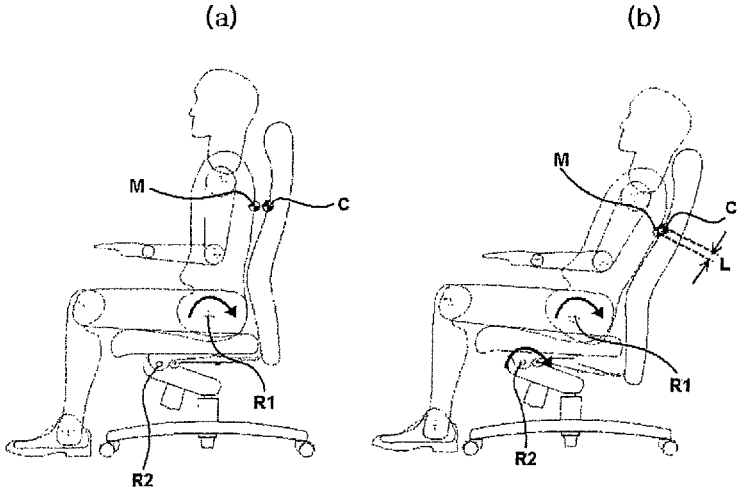
FIGS. 2*a* and 2*b* are views showing the operation of the conventional tiltable chair.
Figure 3:
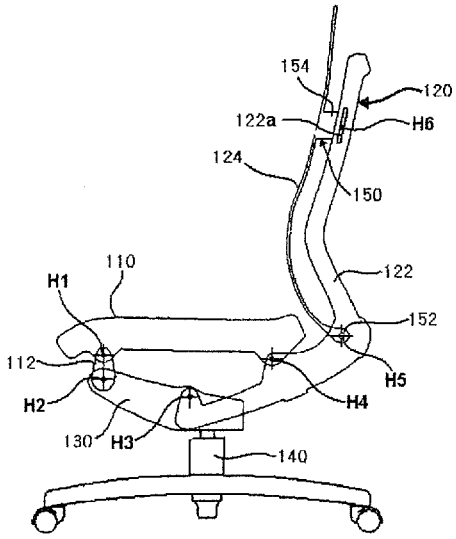
FIG. 3 is a view showing the construction of a tillable chair according to the present invention.

FIG. 3 is a side view showing a tiltable chair according to the present invention. As shown in the drawing, a seat plate body 110 and a back plate body 120 are hinged to a tilt 130, the tilt 130 is connected to a leg 140, and an armrest (not shown) is coupled to a central part of each side edge of the seat plate body 110 so as to support a user's arm.

The back plate body 120 includes a back plate frame 122, and a back plate 124 which is coupled to the back plate frame in such a way as to move up and down with respect to the back plate frame 122 by a moving means 150.

A front part of the seat plate body 110 is hinged to one end of the tilt 130 via a link 112 and first and second hinge shafts H1 and H2. The back plate frame 122 is hinged to the other end of the tilt 130 via a third hinge shaft H3. A rear part of the seat plate body 110 is hinged to the back plate frame 122 via a fourth hinge shaft H4. A base member may be coupled to a bottom of the seat plate body 110.

The moving means 150 includes a lower connecting part 152 arranged with a lower part of the back plate 124 connected to the back plate frame 122, and an upper connecting part 154 arranged with an upper part of the back plate 124 connected to the back plate frame 122. The lower connecting part 152 has a hinge connecting structure using a fifth hinge shaft H5. The upper connecting part 154 has a sliding connecting structure using a sixth hinge shaft H6 and a sliding groove 122*a*.

Figure 4:
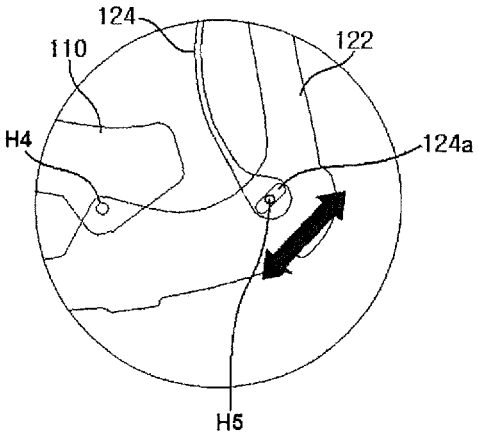
FIG. 4 is a view showing a lower connecting part of a moving means of the tiltable chair, according to an embodiment of the present invention.

As shown in FIG. 4, the lower connecting part 152 may have a sliding connecting structure using the fifth hinge shaft H5 and a sliding groove 124*a*.

Figure 5:
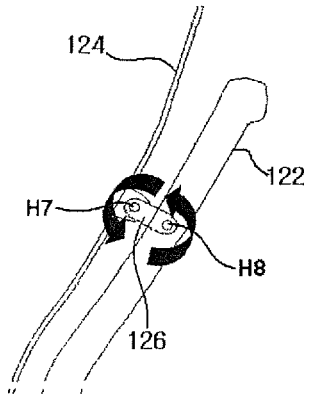
FIG. 5 is a view showing an upper connecting part of the moving means of the tiltable chair, according to an embodiment of the present invention.
Figure 6:
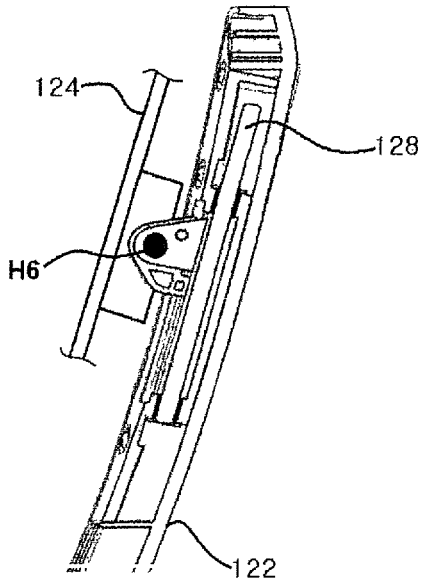
FIG. 6 is a view showing an upper connecting part of the moving means of the tiltable chair, according to another embodiment of the present invention.

As shown in FIG. 5, the upper connecting part 154 may have a link connecting structure using one link 126 and two hinge shafts H7 and H8. Further, as shown in FIG. 6, the upper connecting part 154 may adopt a sliding connecting structure wherein the sixth hinge shaft H6 is connected to a cylinder shaft 128 and the cylinder shaft 128 is slidably guided in a cylinder of the back plate frame 122.

Figure 7:
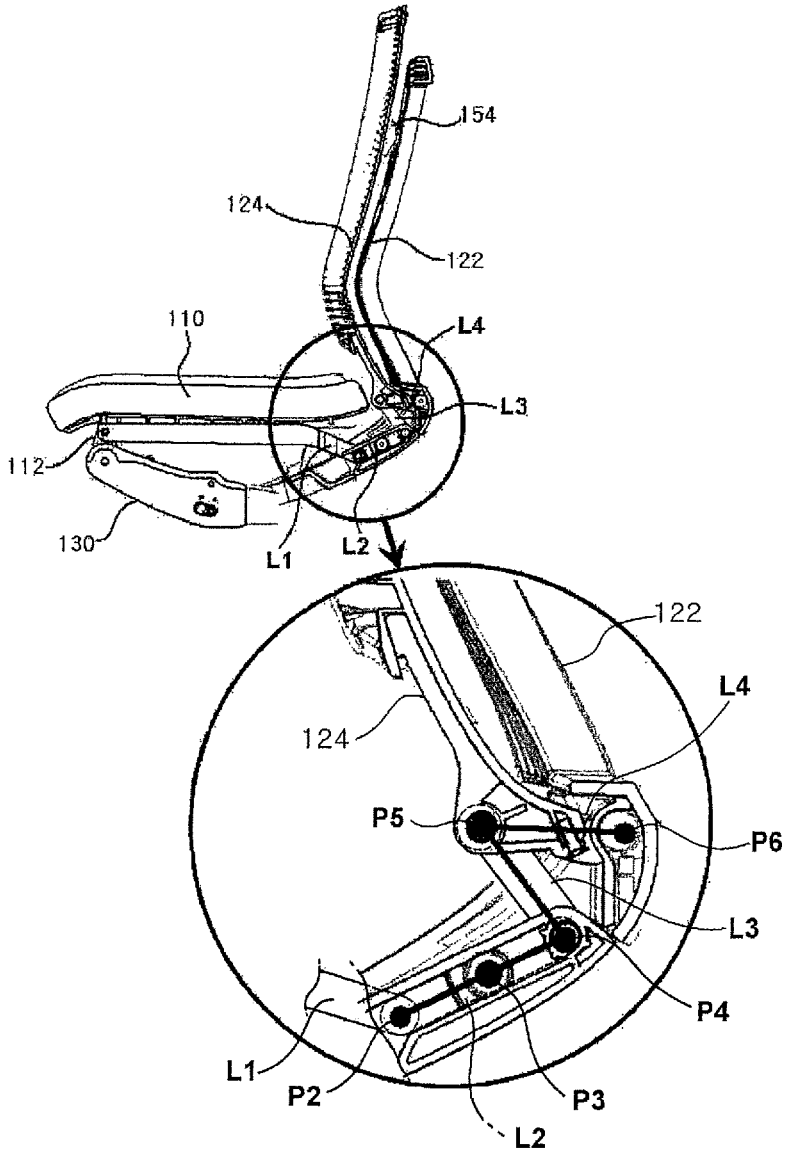
FIG. 7 is a view showing a lower connecting part of the moving means of the tiltable chair, according to another embodiment of the present invention.

Meanwhile, as shown in FIG. 7, the lower connecting part 152 may have a link connecting structure using a plurality of links and hinge shafts. As shown in the drawing, the link connection is made at the lower connecting part 152 by first; second, third, and fourth links L1, L2, L3, and L4. One end of the first link L1 is hinged to the seat plate body 110, while the other end of the first link L1 is hinged to one end of the second link L2. A central part of the second link L2 is hinged to the back plate frame 122, the other end of the second link L2 is hinged to one end of the third link L3, the other end of the third link L3 is hinged to one end of the fourth link L4 and the back plate 124, and the other end of the fourth link L4 is hinged to the back plate frame 122.

The respective links L1, L2, L3, and L4 connect the seat plate with the back plate frame and the backrest in cooperation with a plurality of hinge shafts P1, P2, P3, P4, P5, and P6. That is, the hinge shaft P1 hingedly connects the seat plate body 110 with the first link L1, the hinge shaft P2 hingedly connects the first link L1 with the second link L2, the hinge shaft P3 hingedly connects the second link L2 to the back plate frame 122, the hinge shaft P4 hingedly connects the second link L2 with the third link L3, the hinge shaft P5 hingedly connects the third link L3 with the fourth link L4 and the back plate 124, and the hinge shaft P6 hingedly connects the fourth link L4 with the back plate frame 122.

According to this embodiment, in place of the fourth hinge shaft H4 of FIG. 3, the seat plate body 110 is connected with the back plate frame 122 using the two links L1 and L2 and the hinge shafts P1 and P3.

Figure 8:
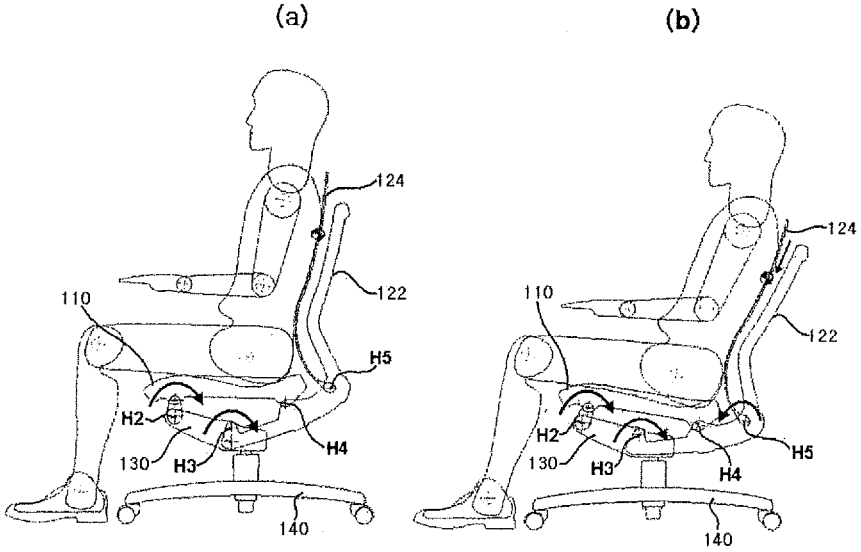
FIGS. 8*a* and 8*b* are views showing the operation of the tiltable chair according to the present invention.

In the tiltable chair according to the present invention constructed as described above, as shown in FIGS. 8*a* and 8*b*, the rotational center (the hinge shaft H3) of the back plate frame 122 is different from the rotational center (the hinge shaft H2) of the seat plate body 110, so that the back plate frame and the seat plate move along different rotating courses when a user tilts. The back plate frame 122 and the seat plate body 110 are connected to each other by the hinge shaft H4, and the upper connecting part 154 of the back plate 124 may move up and down with respect to the back plate frame 122. Hence, if the back plate frame 122 and the seat plate body 110 rotate clockwise, the back plate 124 rotates counterclockwise about the hinge shaft H5 that is the rotational center, so that the back plate 124 moves downwards. Thereby, slippage does not occur between a human body and the back plate, and the back plate can support the lumbar vertebrae, thus always maintaining a state of lordosis, therefore protecting the spine.

Meanwhile, as shown in FIG. 4, in a structure wherein the back plate 124 is slidably coupled to the back plate frame 122 by the fifth hinge shaft H5 and the sliding groove 124*a*, the back plate 124 slidably moves downwards by the sliding groove 124*a*. Further, as shown in FIG. 5, when the upper connecting part 154 has the link connecting structure using one link 126 and the two hinge shafts H7 and H8, the link 126 rotates simultaneously about the hinge shafts H7 and H8, thus resulting in the downward movement of the back plate 124.

Figure 9:
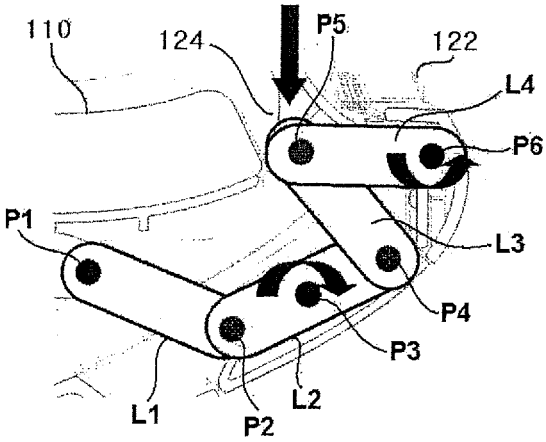
FIG. 9 is a view showing the operation of the lower connecting part of the moving means shown in FIG. 7.

Further, as shown in FIG. 7, when the lower connecting part 152 of the moving means 150 has the link connecting structure using the plurality of links and hinge shafts, the hinge shaft P1 is connected to the seat plate body 110, the hinge shafts P3 and P6 are connected to the back plate frame 122, the hinge shaft P5 is connected to the back plate 124, thus having a degree of freedom upon rotation, and the hinge shafts P2 and P4 have a degree of freedom between the links. Thus, as shown in the operational view of FIG. 9, when a user tilts, a distance between the hinge shaft P1 and the hinge shaft P3 increases because of a difference in rotational course between the seat plate body 110 and the back plate frame 122. The hinge shafts P2 and P4 rotate clockwise with respect to the hinge shaft P3, thus compensating for an increasing distance between the hinge shafts P1 and P3. At this time, as the hinge shaft P4 rotates clockwise based on the hinge shaft P3, the hinge shaft P5 rotates counterclockwise about the hinge shaft P6, so that the back plate 124 is moved downwards with respect to the back plate frame 122. Thereby, the chair has the same behavior as a human body.

The invention claimed is:

1. A tiltable chair constructed so that a seat plate body and a back plate body are coupled to a tilt to allow the chair to be tilted, wherein the back plate body comprises a back plate frame and a back plate which is coupled to the back plate frame in such a way as to move up and down with respect to the back plate frame by moving means, a front part of the seat plate body is coupled to one side of the tilt, the back plate frame is coupled to another side of the tilt, and a rear part of the seat plate body is coupled to the back plate body, wherein the moving means comprise a lower connecting part arranged with a lower part of the back plate connected to the back plate frame, the lower connecting part has a link connecting structure using a plurality of links comprising first, second, third, and fourth links, and wherein one end of the first link is hinged to the seat plate body, the other end of the first link is hinged to one end of the second link, a central part of the second link is hinged to the back plate frame, the other end of the second link is hinged to one end of the third link, the other end of the third link is hinged to one end of the fourth link and the back plate, the other end of the fourth link is hinged to the back plate frame.

2. The tiltable chair according to claim 1, wherein the moving means further comprises an upper connecting part arranged with an upper part of the back plate connected to the back plate frame.

3. The tiltable chair according to claim 1, wherein the upper connecting part has a sliding connecting structure.

4. The tiltable chair according to claim 1, wherein the upper connecting part has a link connecting structure using one link.

5. The tiltable chair according to claim 1, wherein a hinge shaft (P1) provided on a lower end of a rear part of the lower end of a rear part of the seat plate is hinged to a hinge shaft (P3) of the back plate frame so that a distance between the lower end of the rear part of the seat plate body and a lower end of the back plate frame increases when the back plate body is tilted rearwards.

* * * * *